US008424871B2

(12) United States Patent
Ino

(10) Patent No.: US 8,424,871 B2
(45) Date of Patent: Apr. 23, 2013

(54) MEDIUM MOUNTING DEVICE, MEDIUM READING DEVICE, AND MULTIFUNCTION PRODUCT

(75) Inventor: Shiro Ino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/231,277

(22) Filed: Sep. 13, 2011

(65) Prior Publication Data

US 2012/0061902 A1 Mar. 15, 2012

(30) Foreign Application Priority Data

Sep. 14, 2010 (JP) ..... 2010-205514

(51) Int. Cl.
*B65H 31/26* (2006.01)

(52) U.S. Cl.
USPC ..... 271/220; 271/223

(58) Field of Classification Search ..... 271/207, 271/213, 220, 223
See application file for complete search history.

(56) References Cited

U.S. PATENT DOCUMENTS

| | | | | |
|---|---|---|---|---|
| 6,522,860 | B2 * | 2/2003 | Nose et al. | 399/374 |
| 7,547,015 | B2 * | 6/2009 | Lee et al. | 271/213 |
| 2009/0224463 | A1 * | 9/2009 | Chinzei et al. | 271/207 |

FOREIGN PATENT DOCUMENTS

| | | | |
|---|---|---|---|
| JP | 64-021166 | U | 2/1989 |
| JP | 2005-231795 | A | 9/2005 |

* cited by examiner

*Primary Examiner* — Michael McCullough
(74) *Attorney, Agent, or Firm* — Kubotera & Associates, LLC

(57) ABSTRACT

A medium mounting device includes a medium mounting portion for placing a medium in a stacked state in a first direction, and a medium regulating portion arranged to be rotatable relative to the medium mounting portion. The medium regulating portion is arranged to regulate an edge portion of the medium when the medium regulating portion is in a rising state relative to the medium mounting portion. The medium regulating portion in the rising state is arranged to abut against the medium to rotate and retreat when the medium is taken out in a second direction different from the first direction.

15 Claims, 20 Drawing Sheets

MEDIUM MOUNTING DEVICE, MEDIUM READING DEVICE, AND MULTIFUNCTION PRODUCT

BACKGROUND OF THE INVENTION AND RELATED ART STATEMENT

The present invention relates to a medium mounting device capable of mounting a medium in a stacked state, a medium reading device including the medium mounting device, and a multifunction product (MFP) including the medium mounting device.

A conventional image forming apparatus is provided with a discharge tray as a medium mounting device. The discharge tray includes a medium receiving portion for regulating a leading edge of a medium discharged on the discharge tray in a medium regulation direction (that is, a direction opposite to a discharge direction of the medium), so that the medium is placed and aligned on the discharge tray. The medium receiving portion functions as a medium regulating portion for abutting against the leading edge of the medium (refer to Patent Reference). When the medium is taken out, a user picks upwardly the medium placed on the discharge tray.

Patent Reference: Japanese Patent Publication No. 2005-231795

In the conventional image forming apparatus, when another unit is disposed above the discharge tray, it is difficult for the user to take out the medium placed on the discharge tray. Further, in this case, when the user tries to take out the medium placed on the discharge tray in a direction opposite to the medium regulation direction of the medium receiving portion, the medium receiving portion may block the medium, thereby making it difficult to take out the medium.

In view of the problems described above, an object of the present invention is to provide a medium mounting device, a medium reading device, and a multifunction product capable of solving the problems of the conventional medium mounting device. In the present invention, it is possible to easily take out a medium placed on a medium mounting portion of the medium mounting device.

Further objects and advantages of the invention will be apparent from the following description of the invention.

SUMMARY OF THE INVENTION

In order to attain the objects described above, according to a first aspect of the present invention, a medium mounting device includes a medium mounting portion for placing a medium in a stacked state in a first direction, and a medium regulating portion arranged to be rotatable relative to the medium mounting portion. The medium regulating portion is arranged to regulate an edge portion of the medium when the medium regulating portion is in a rising state relative to the medium mounting portion. The medium regulating portion in the rising state is arranged to abut against the medium to rotate and retreat when the medium is taken out in a second direction different from the first direction.

According to a second aspect of the present invention, a medium reading device includes the medium mounting device described above; a medium placing portion disposed in a direction different from the second direction of the medium mounting portion of the medium mounting device; a reading portion for optically reading an image at a reading position; and a transportation portion for transporting the medium placed on the medium placing portion to the medium mounting portion of the medium mounting device through the reading position of the reading portion.

According to a third aspect of the present invention, a multifunction device includes the medium mounting device described above.

According to a fourth aspect of the present invention, a multifunction device includes the medium reading device described above.

According to the present invention, it is possible to easily take out the medium placed on the medium mounting portion of the medium mounting device.

DETAILED DESCRIPTION OF PREFERRED EMBODIMENTS

Hereunder, embodiments of the present invention will be explained with reference to the accompanying drawings.

First Embodiment

Figure 1:
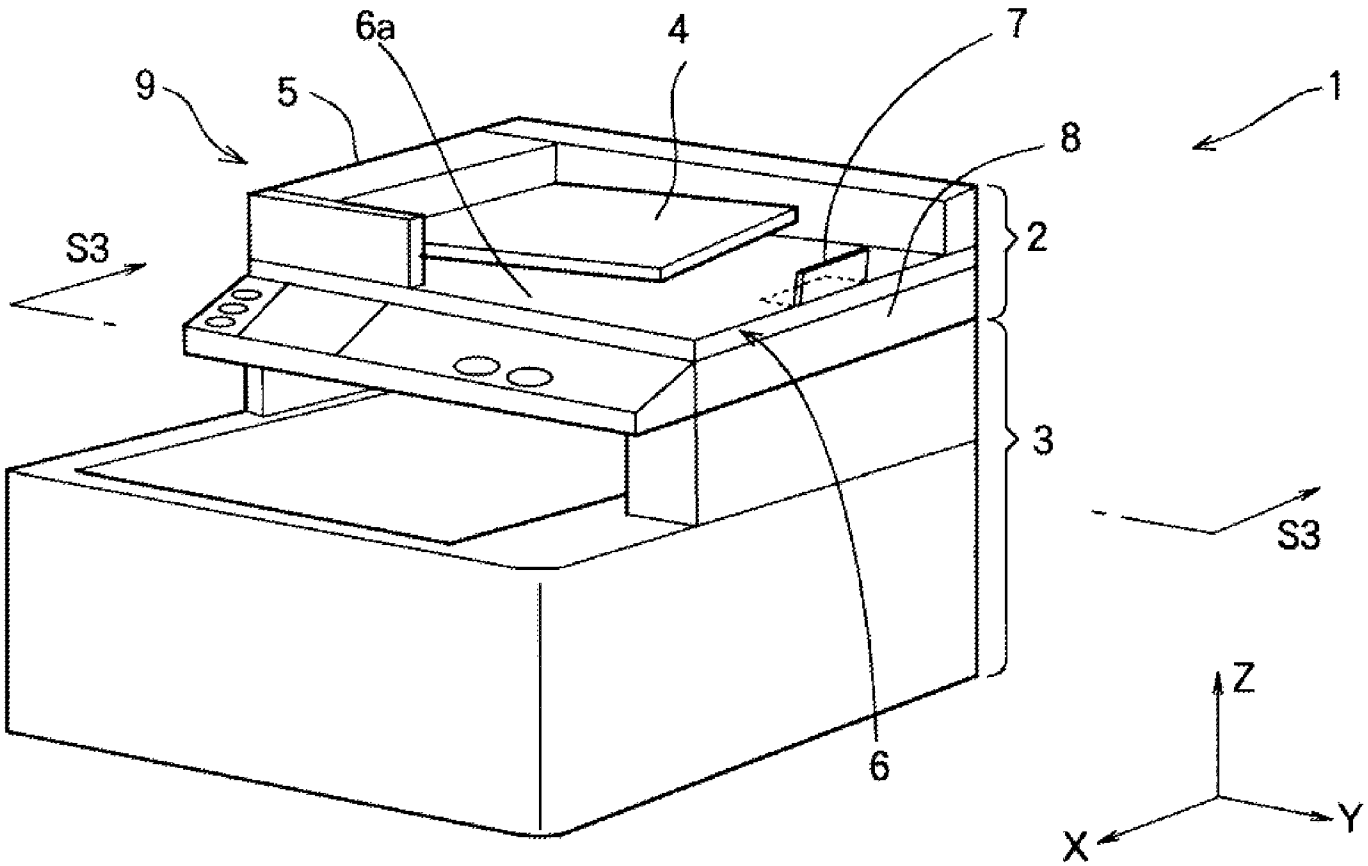
FIG. 1 is a schematic perspective view showing an outer appearance of a multifunction product according to a first embodiment of the present invention.

A first embodiment of the present invention will be explained. FIG. 1 is a schematic perspective view showing an outer appearance of a multifunction product 1 (also referred to as a multifunction peripheral or an MFP) according to the first embodiment of the present invention. As shown in FIG. 1, the multifunction product 1 includes a medium reading device 2 (also referred to as a document reading device or a medium reading portion) and a printer portion 3.

In the embodiment, the medium reading device 2 is provided for optically reading an image of a medium (also referred to as a document or a document sheet), and for transmitting image data obtained through reading to the printer portion 3. The medium reading device 2 includes a document tray 4 (also referred to as a sheet supply tray), a transportation portion 5, a medium mounting device 6, and a flat bed 8.

In the embodiment, the medium mounting device 6 includes a medium mounting portion 6*a* for placing and mounting the medium on an upper surface thereof, and a stopper portion 7 as a medium regulating portion disposed at an edge portion of the medium mounting portion 6*a* to be rotatable. The document tray 4, the transportation portion 5, and the medium mounting device 6 constitute an automatic document feeder 9 (an ADF), in which the transportation portion 5 transports the document mounted on the document tray 4 to the medium mounting portion 6*a*.

In the embodiment, the printer portion 3 is provided for forming (printing) the image on a recording sheet according to the image information received from the medium reading device 2 using, for example, an electro-photography method. The printing portion 3 may have a facsimile function of transmitting and receiving the image information through a network and the like, and a scanner function of transmitting the image information received from the medium reading device 2 to an information processing apparatus (not shown) through a network and the like. It is noted that FIG. 1 shows coordinate axes X, Y, and Z of an orthogonal coordinate system in a three-dimensional space. The coordinate axes X, Y, and Z are common to other drawings.

Figure 2:
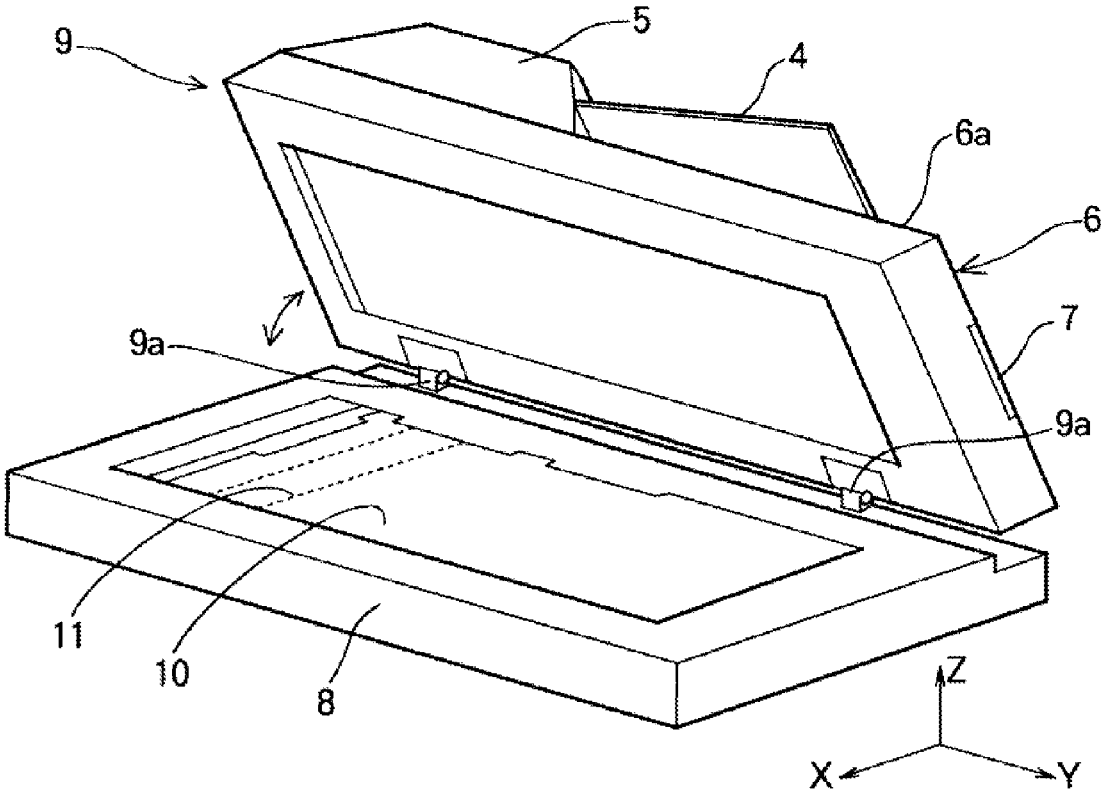
FIG. 2 is a schematic perspective view showing an outer appearance of a medium reading device of the multifunction product according to the first embodiment of the present invention.

FIG. 2 is a schematic perspective view showing an outer appearance of the medium reading device 2 of the multifunction product 1 according to the first embodiment of the present invention. As shown in FIG. 2, the medium reading device 2 includes the flat bed 8, the automatic document feeder 9, and a hinge portion 9*a* for supporting the automatic document feeder 9 on the flat bed 8 to be rotatable.

In the embodiment, the flat bed 8 includes a glass surface portion 10 for placing the document. The ADF 9 is capable of rotating around the hinge portion 9*a*, so that the document is pressed against the glass surface portion 10. Further, the medium reading device 2 includes a reading portion 11 having an optical element for optically reading the image of the document. The reading portion 11 is capable of reading the document transported with the automatic document feeder 9 and passing through a specific reading position. Further, the reading portion 11 is also capable of moving the Y direction to read the image of the document on the glass surface portion 10.

Figure 3:
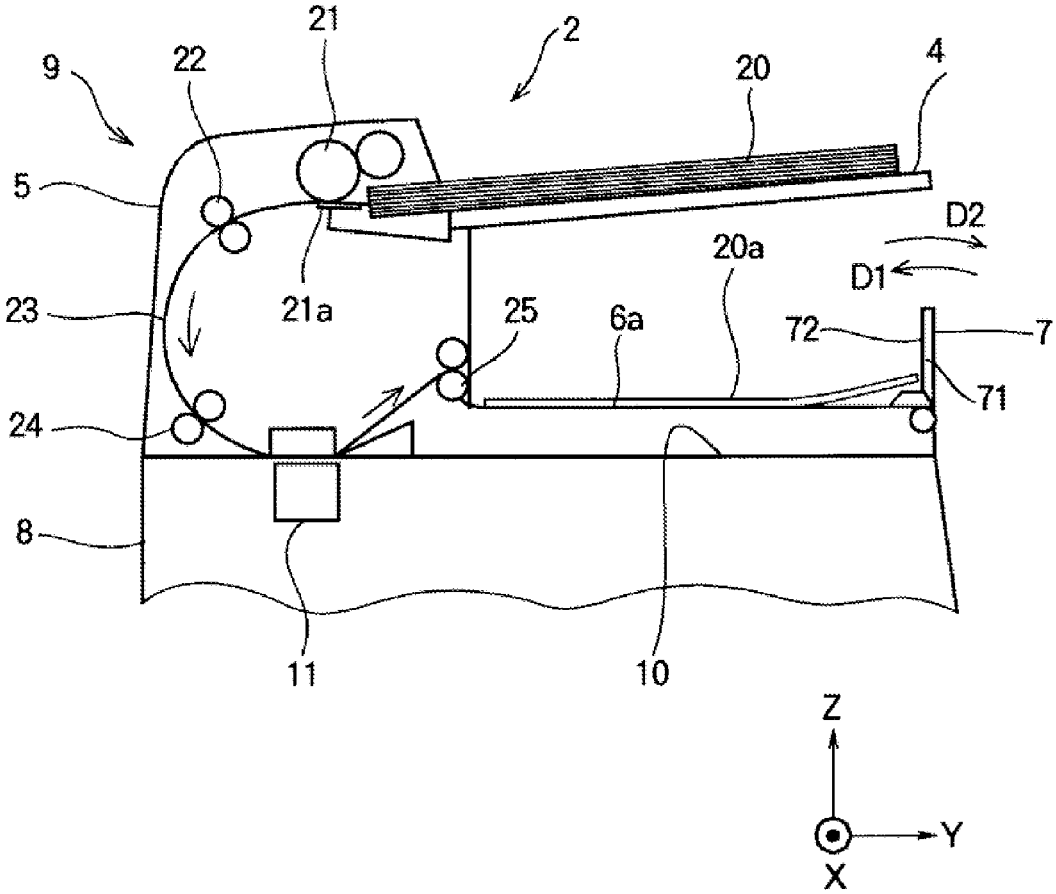
FIG. 3 is a schematic sectional view showing the multifunction product taken along a line S3-S3 in FIG. 1 according to the first embodiment of the present invention.

FIG. 3 is a schematic sectional view showing the multifunction product 1 taken along a line S3-S3 in FIG. 1 according to the first embodiment of the present invention.

As shown in FIG. 3, the transportation portion 5 of the automatic document feeder 9 includes a feed roller 20 and a tongue member 21*a* for separating a document 20 placed in the document tray 4 one by one; a sheet supply roller 22; a transportation path 23; a sheet supply roller 24; and a discharge roller 25. The feed roller 20 and the tongue member 21*a* are provided for separating the document 20 placed in the document tray 4 one by one, and for transporting the feed roller 20 inside the transportation portion 5. The sheet supply rollers 22 and 24 are provided for transporting the feed roller 20 along the transportation path 23 to the reading position of the reading portion 11. The discharge roller 25 is provided for discharging the feed roller 20 on the medium mounting portion 6*a*. After the discharge roller 25 discharges the feed roller 20, the feed roller 20 is mounted on the medium mounting portion 6*a* in the Z direction as a first direction (a vertical direction). The stopper portion 7 as the medium regulating portion is disposed at the edge portion of the medium mounting portion 6*a*.

As shown in FIG. 3, in the ADF 9, the document tray 4 is arranged above the medium mounting portion 6*a*. Accordingly, when a document 20*a* is placed on the medium mounting portion 6*a*, it is difficult to take out the document 20*a* in the Z direction (an upward direction in FIG. 3). As a result, when a user tries to take out the document 20*a* mounted on the medium mounting portion 6*a*, it is necessary for the user to take out the document 20*a* in the Y direction (a second direction) opposite to a medium regulating direction of the stopper portion 7 (the Y direction).

Figure 4:
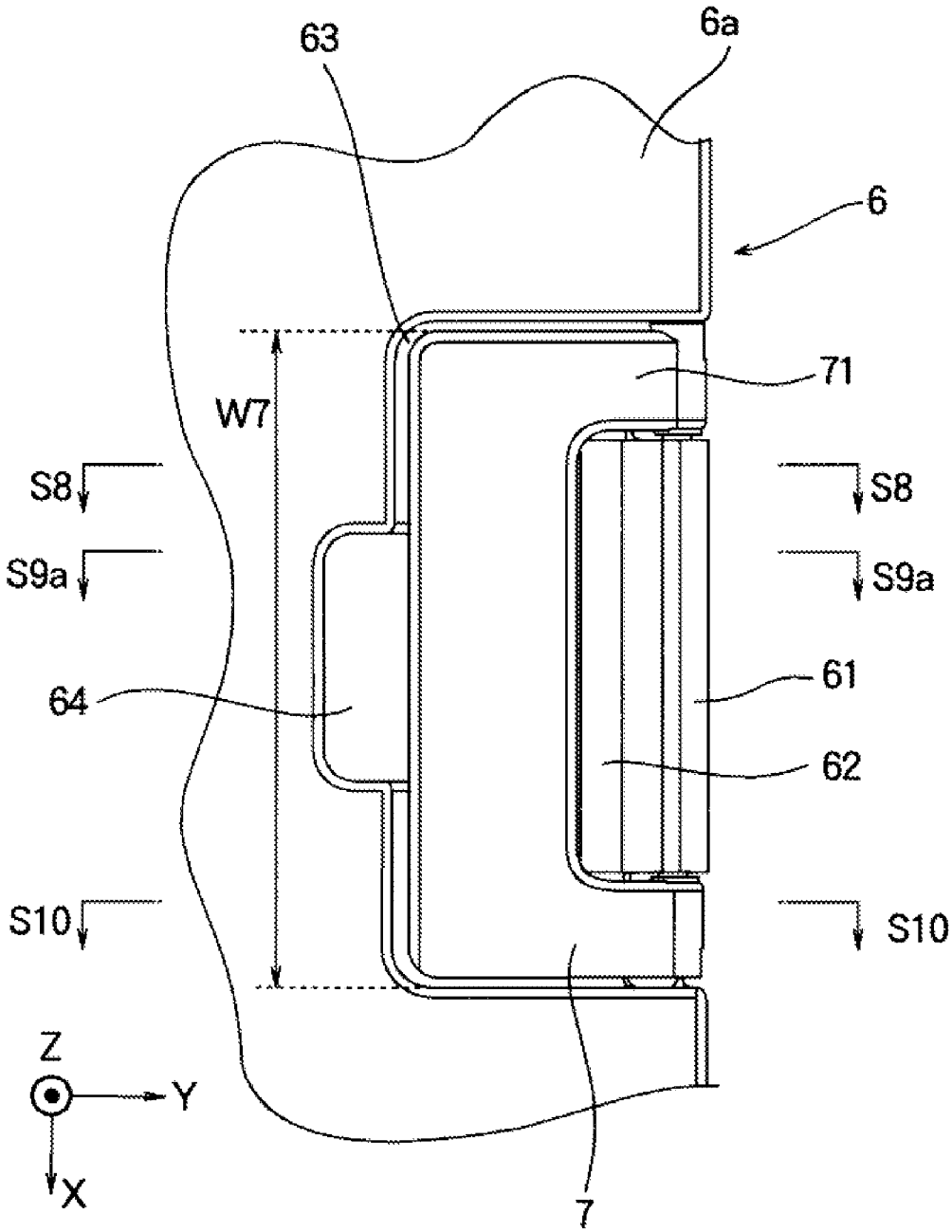
FIG. 4 is a schematic plan view showing a medium mounting device of the multifunction product according to the first embodiment of the present invention.
Figure 5:
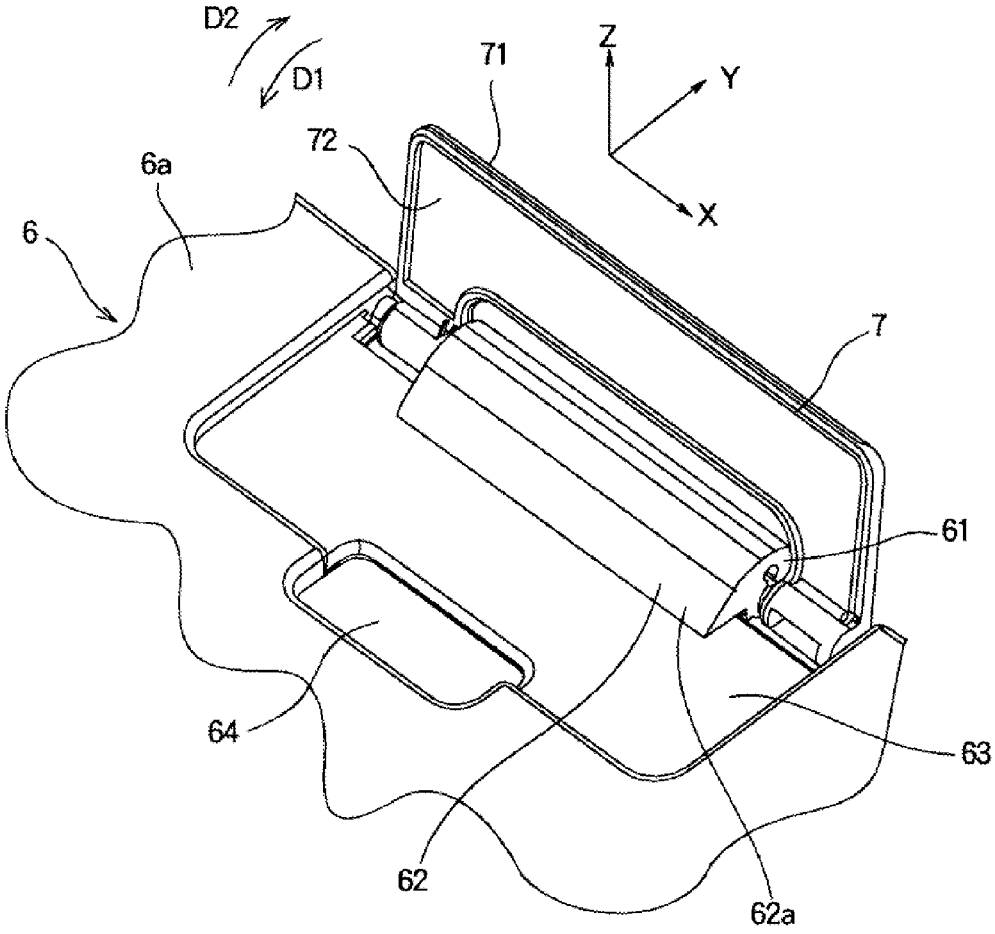
FIG. 5 is a schematic perspective view showing a medium mounting portion of the medium mounting device of the multifunction product according to the first embodiment of the present invention.

FIG. 4 is a schematic plan view showing the medium mounting device 6 of the multifunction product 1 according to the first embodiment of the present invention. FIG. 5 is a schematic perspective view showing the medium mounting portion 6*a* of the medium mounting device 6 of the multifunction product 1 according to the first embodiment of the present invention. As shown in FIGS. 4 and 5, the stopper portion 7 as the medium regulating portion is disposed at the edge portion of the medium mounting portion 6*a* in a medium discharging direction (the Y direction) to be rotatable relative to the medium mounting portion 6*a*.

As shown in FIGS. 4 and 5, the medium mounting portion 6*a* includes a shaft receiving portion 61 for supporting the stopper portion 7 to be rotatable; an inclined portion 62 disposed on an upstream side of the stopper portion 7 in the medium discharging direction and having an inclined surface with a height in the Z direction increasing toward the stopper portion 7; a first recessed portion 63 for accommodating the stopper portion 7; and a second recessed portion 64 for accommodating a finger of the user when the user lifts the stopper portion 7 in a stored state. It is noted that the second recessed portion 64 has a depth greater than that of the first recessed portion 63.

As shown in FIG. 5, when the stopper portion 7 is in a rising state standing up from the medium mounting portion 6*a*, the stopper portion 7 is capable of regulating an edge portion of the document 20*a* placed on the medium mounting portion 6*a*. When the document 20*a* placed on the medium mounting portion 6*a* is taken out in the second direction, for example, the Y direction, different from the first direction (the Z direction), the stopper portion 7 in the rising state abuts against the edge portion of the document 20*a* and rotate to retract (for example, rotate in a direction D2).

In the embodiment, it is preferred that the stopper portion 7 has a width W7 (refer to FIG. 4) smaller than a minimum width of a document that the multifunction product 1 is capable of handling. Accordingly, when the document 20*a* placed on the medium mounting portion 6*a* is moved in the Y direction and taken out of the multifunction product 1, it is possible to easily grab both edge portions of the document 20*a*. IN this case, the user grads the both edge portions of the document 20*a* discharged on the medium mounting portion 6*a* with hands, so that it is possible to take out the document 20*a* in the Y direction.

Figure 6:
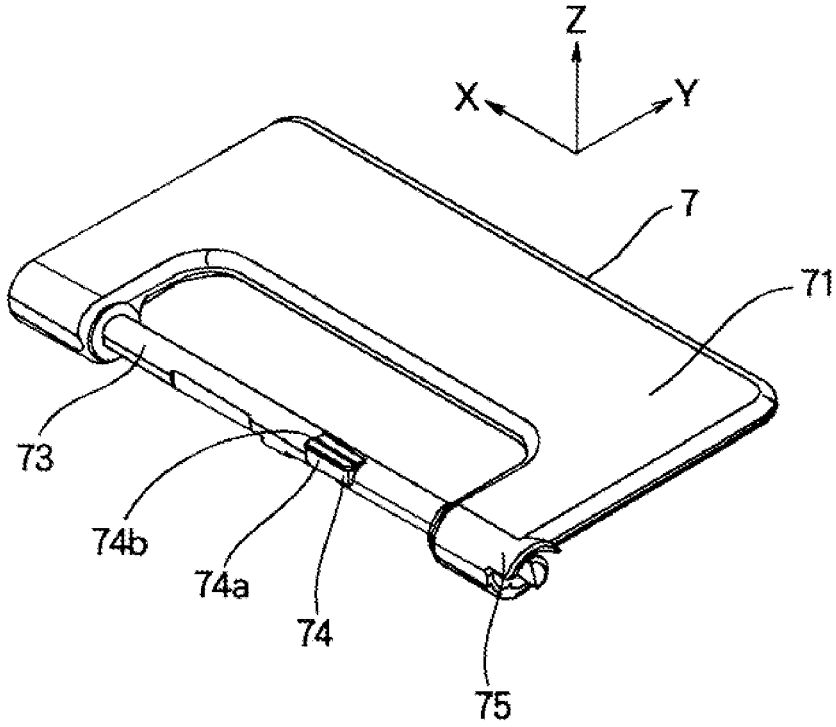
FIG. 6 is a schematic perspective view showing a stopper portion of the medium mounting device of the multifunction product in a state that a front surface of the stopper portion faces upward according to the first embodiment of the present invention.
Figure 7:
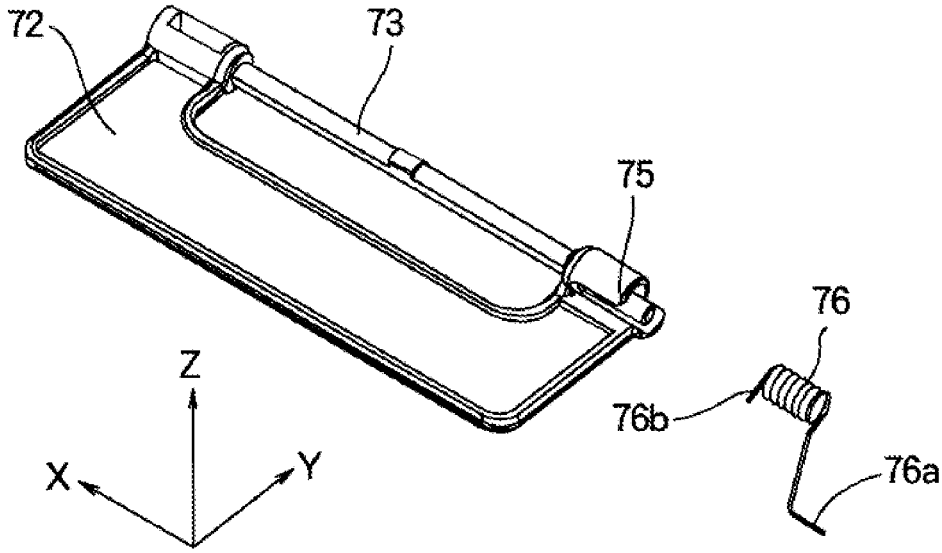
FIG. 7 is a schematic perspective view showing a torsion spring and the stopper portion of the medium mounting device of the multifunction product in a state that a backside surface of the stopper portion faces upward according to the first embodiment of the present invention.
Figure 8:
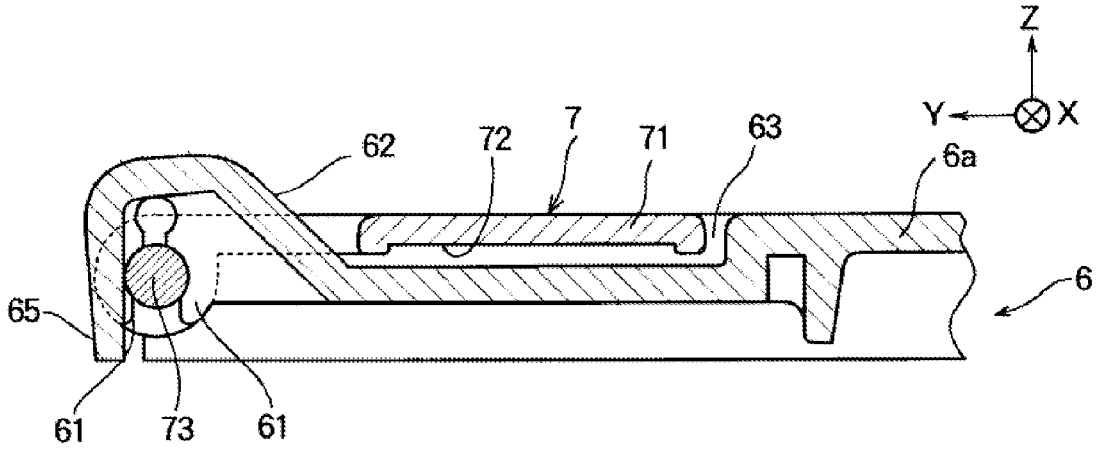
FIG. 8 is a schematic sectional view showing the medium mounting device of the multifunction product taken along a line S8-S8 in FIG. 4 according to the first embodiment of the present invention.

FIG. 6 is a schematic perspective view showing the stopper portion 7 of the medium mounting device 6 of the multifunction product 1 in a state that a front surface 71 of the stopper portion 7 faces upward according to the first embodiment of the present invention. FIG. 7 is a schematic perspective view showing a torsion spring 76 as an urging member and the stopper portion 7 of the medium mounting device 6 of the multifunction product 1 in a state that a backside surface 72 of the stopper portion 7 faces upward according to the first embodiment of the present invention. FIG. 8 is a schematic sectional view showing the medium mounting device 6 of the multifunction product 1 taken along a line S8-S8 in FIG. 4 according to the first embodiment of the present invention.

Figure 9A:
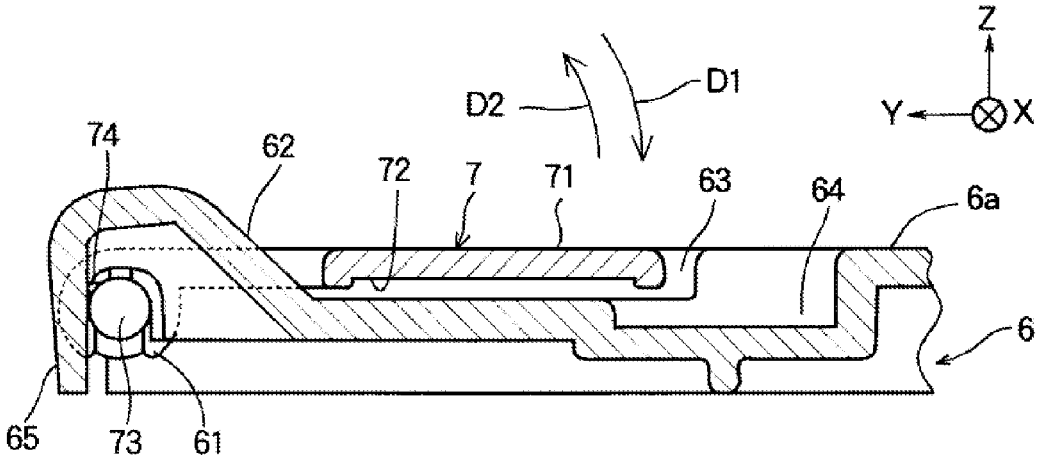
FIGS. 9(*a*) and 9(*b*) are schematic views showing the medium mounting device of the multifunction product according to the first embodiment of the present invention, wherein FIG. 9(*a*) is a schematic sectional view showing the medium mounting device taken along a line S9*a*-S9*a* in FIG. 4, and FIG. 9(*b*) is an enlarged view showing a protruding portion of the medium mounting device.
Figure 9B:
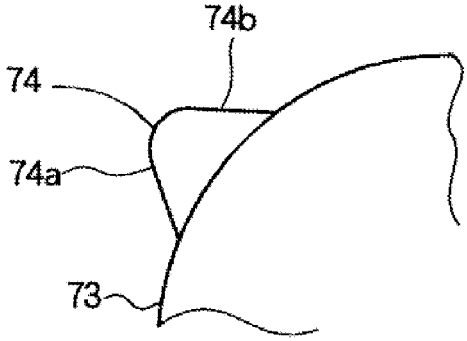
Figure 10:
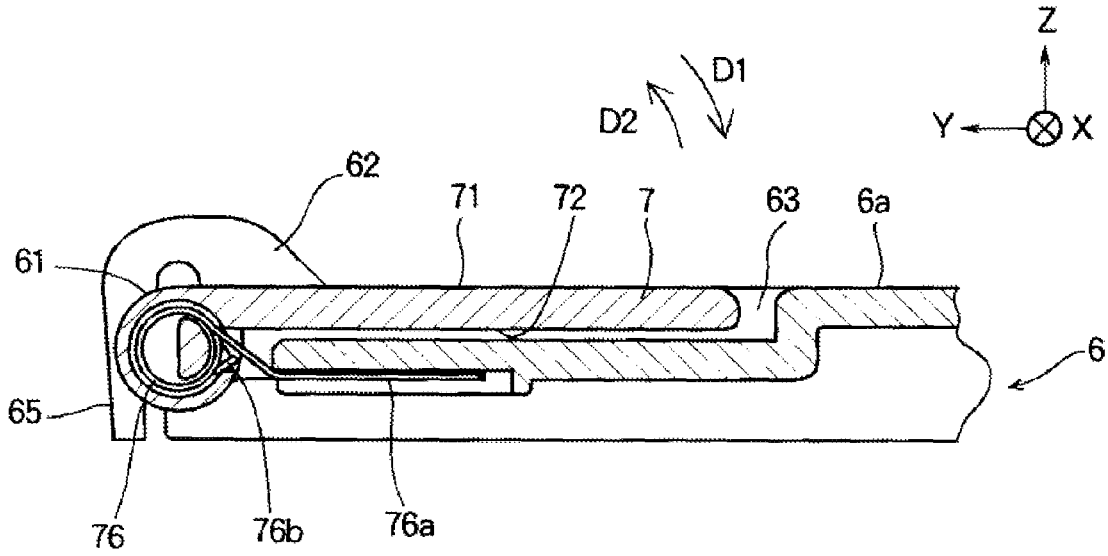
FIG. 10 is a schematic sectional view showing the medium mounting device of the multifunction product taken along a line S10-S10 in FIG. 4 according to the first embodiment of the present invention.

FIGS. 9(*a*) and 9(*b*) are schematic views showing the medium mounting device 6 of the multifunction product 1 according to the first embodiment of the present invention. More specifically, FIG. 9(*a*) is a schematic sectional view showing the medium mounting device 6 taken along a line S9*a*-S9*a* in FIG. 4, and FIG. 9(*b*) is an enlarged view showing a protruding portion 74 of the medium mounting device 6. FIG. 10 is a schematic sectional view showing the medium mounting device 6 of the multifunction product 1 taken along a line S10-S10 in FIG. 4 according to the first embodiment of the present invention. It is noted that the stopper portion 7 is in the stored state in FIGS. 8, 9(*a*), 9(*b*), and 10.

As shown in FIGS. 6 to 10, the stopper portion 7 includes a shaft portion 73 with a circular cylindrical shape supported on the shaft receiving portion 61 of the medium mounting portion 6*a* to be rotatable. Further, as shown in FIGS. 6, 9(*a*) and 9(*b*), the stopper portion 7 includes the protruding portion 74 disposed on an outer circumferential surface of the shaft portion 73. The protruding portion 74 includes a first abutting surface 74*a* and a second abutting surface 74*b*.

As shown in FIGS. 7 and 10, the shaft portion 73 is provided with the torsion spring 76 as the urging member. Accordingly, when the document 20*a* placed on the medium mounting portion 6*a* is pulled out in the medium discharging direction and the stopper portion 7 falls outside from the rising state, the stopper portion 7 returns to the rising state substantially perpendicular to the medium mounting portion 6*a*. The torsion spring 76 is disposed in a cylindrical portion 75 formed as a part of the stopper portion 7 in a cylindrical shape.

In the embodiment, the torsion spring 76 includes a first arm portion 76*a* and a second arm portion 76*b* shorter than the first arm portion 76*a* (refer to FIG. 7). As shown in FIG. 10, the first arm portion 76*a* is arranged to engage with a hooking portion on a backside surface of the medium mounting portion 6*a*, and the second arm portion 76*b* is arranged to engage a hooking portion at an edge portion of the cylindrical portion 75 of the stopper portion 7. As explained above, the second arm portion 76*b* engaging the stopper portion 7 has a short length, so that the second arm portion 76*b* does not protrude outside the cylindrical portion 75. The torsion spring 76 as the urging member urges the stopper portion 7 around the shaft portion 73 in a direction D1 shown in FIGS. 9(*a*), 9(*b*), and 10, that is, in the direction that the stopper portion 7 is stored in the medium mounting portion 6*a*.

Figure 11A:
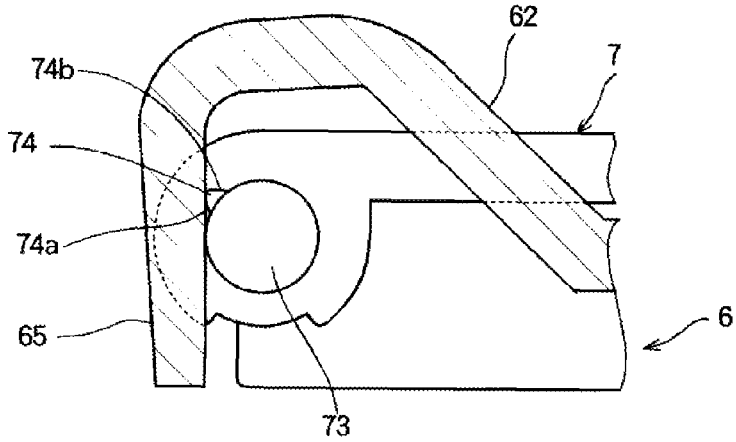
FIGS. 11(*a*) to 11(*c*) are schematic sectional views showing the stopper portion of the medium mounting device of the multifunction product according to the first embodiment of the present invention, wherein FIG. 11(*a*) is a schematic sectional view showing the stopper portion of the medium mounting device in a stored state, FIG. 11(*b*) is a schematic sectional view showing the stopper portion of the medium mounting device in a middle of a rotational state, and FIG. 11(*c*) is a schematic sectional view showing the stopper portion of the medium mounting device in a rising state.
Figure 11B:
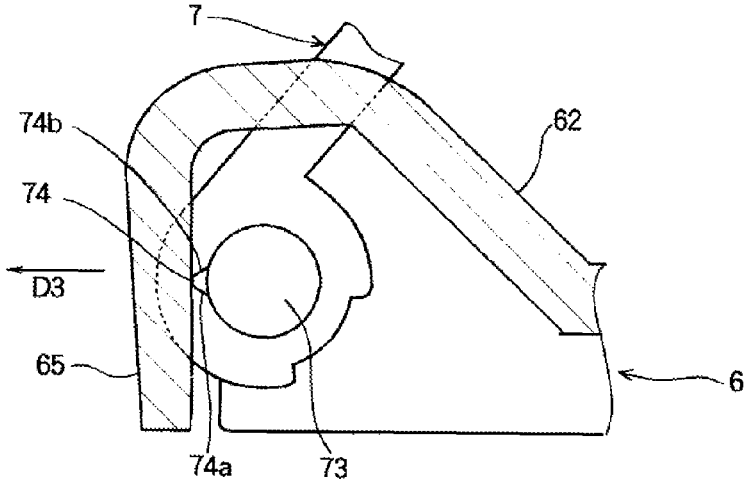
Figure 11C:
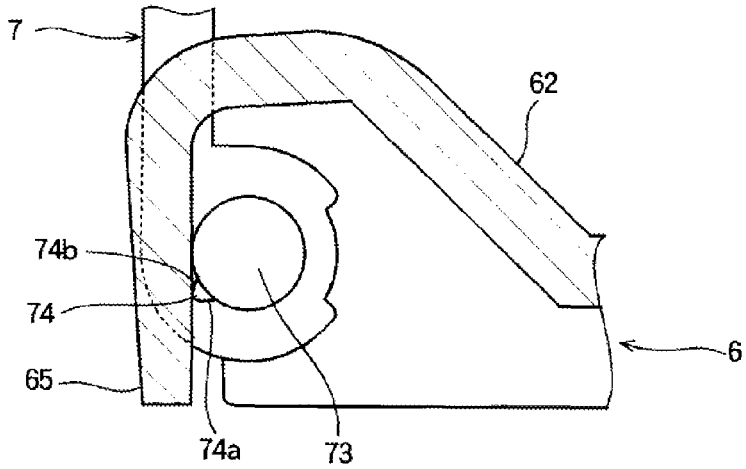

FIGS. 11(*a*) to 11(*c*) are schematic sectional views showing the stopper portion 7 of the medium mounting device 6 of the multifunction product 1 according to the first embodiment of the present invention. More specifically, FIG. 11(*a*) is a schematic sectional view showing the stopper portion 7 of the medium mounting device 6 in the stored state, FIG. 11(*b*) is a schematic sectional view showing the stopper portion 7 of the medium mounting device 6 in a middle of a rotational state, and FIG. 11(*c*) is a schematic sectional view showing the stopper portion 7 of the medium mounting device 6 in the rising state. As shown in FIGS. 11(*a*) to 11(*c*), the medium mounting portion 6*a* includes a wall surface portion 65 formed of a metal or an elastic material capable of elastically deforming such as a resin.

In the embodiment, when the stopper portion 7 in the rising state (refer to FIG. 11(*c*)) is switched to the stored state (refer to FIG. 11(*a*)), the user rotates 07 in the rising state (refer to FIG. 11(*c*)) with a hand in the direction D1 to the stored state (refer to FIG. 11(*a*)). More specifically, when the stopper portion 7 is in the rising state (refer to FIG. 11(*c*)), the second abutting surface 74*b* of the protruding portion 74 abuts against the wall surface portion 65 of the medium mounting portion 6*a*. When the stopper portion 7 is rotated and becomes the middle of the rotational state shown in FIG. 11(*b*), the protruding portion 74 pushes the wall surface portion 65 of the medium mounting portion 6*a*, so that the wall surface portion 65 elastically deforms in a direction D3. When the stopper portion 7 is rotated further and becomes the stored state shown in FIG. 11(*a*), the wall surface portion 65 of the medium mounting portion 6*a* deforms less, and the first abutting surface 74*a* of the protruding portion 74 abuts against the wall surface portion 65 of the medium mounting portion 6*a*.

As shown in FIGS. 9(*a*) and 11(*a*) to 119*c*), when the user rotates the stopper portion 7 in the direction D1, the protruding portion 74 formed on the shaft portion 73 pushes and elastically deforms the wall surface portion 65 of the medium mounting portion 6*a* in the direction D3. Accordingly, the first abutting surface 74*a* abuts against the wall surface portion 65, and the stopper portion 7 is maintained in the stored state. It is suffice that the first abutting surface 74*a* regulates the stopper portion 7 so as to not rotate excessively, and the first abutting surface 74*a* does not necessarily need to abut against the wall surface portion 65 as in the embodiment.

Figure 12A:
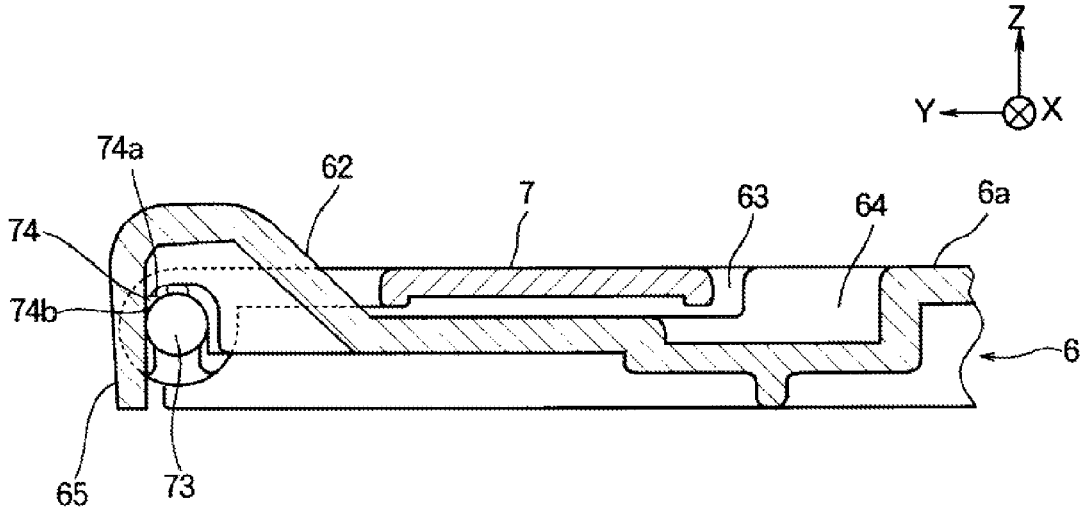
FIGS. 12(*a*) and 12(*b*) are schematic sectional views showing the medium mounting device of the multifunction product according to the first embodiment of the present invention, wherein FIG. 12(*a*) is a schematic sectional view showing the medium mounting device when the stopper portion is in the stored state, and FIG. 12(*b*) is a schematic sectional view showing the torsion spring of the medium mounting device when the stopper portion in the stored state.
Figure 12B:
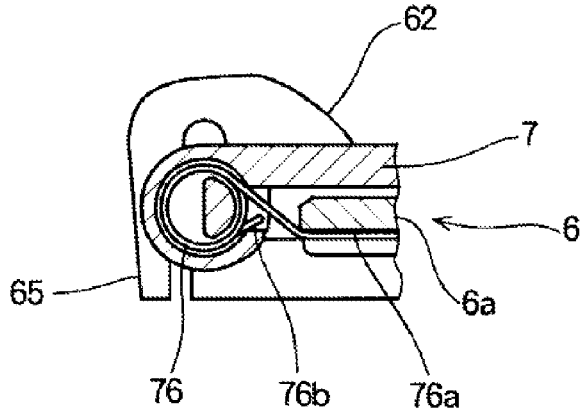

An operation of the medium mounting device 6 of the multifunction product 1 will be explained next. FIGS. 12(*a*) and 12(*b*) are schematic sectional views showing the medium mounting device 6 of the multifunction product 1 according to the first embodiment of the present invention. More specifically, FIG. 12(*a*) is a schematic sectional view showing the medium mounting device 6 when the stopper portion 7 is in the stored state, and FIG. 12(*b*) is a schematic sectional view showing the torsion spring 76 of the medium mounting device 6 when the stopper portion 7 in the stored state.

Figure 13A:
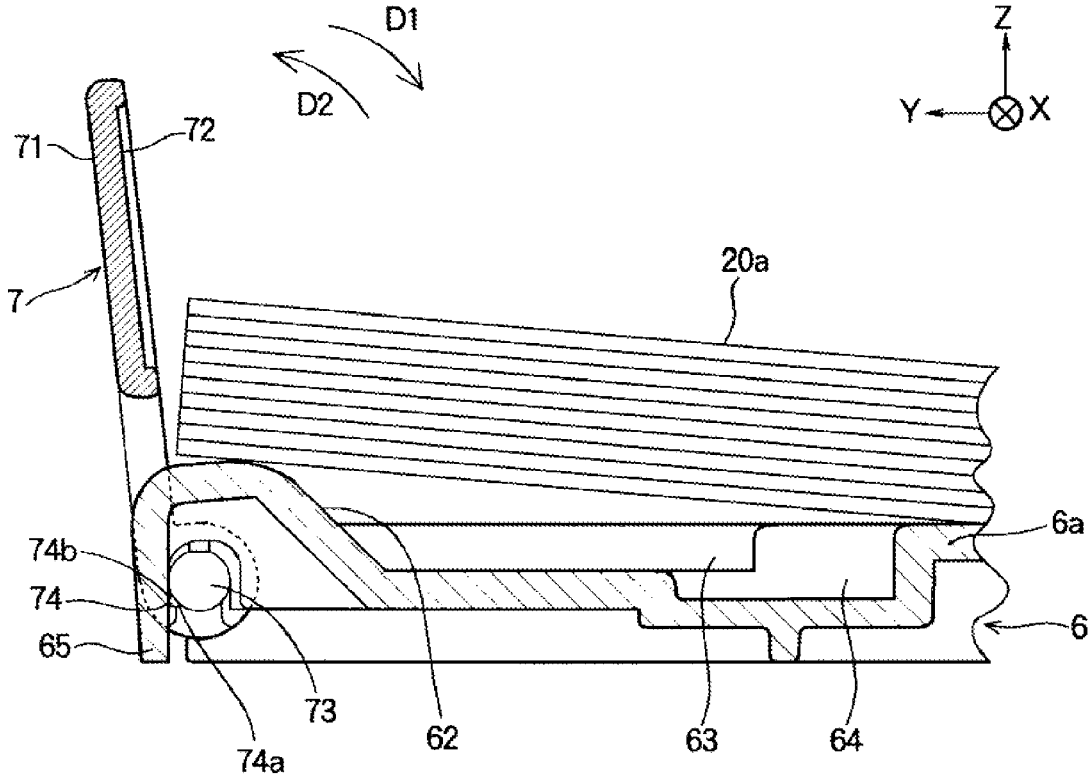
FIGS. 13(*a*) and 13(*b*) are schematic sectional views showing the medium mounting device of the multifunction product according to the first embodiment of the present invention, wherein FIG. 13(*a*) is a schematic sectional view showing the medium mounting device when the stopper portion is in the rising state, and FIG. 13(*b*) is a schematic sectional view showing the torsion spring of the medium mounting device when the stopper portion in the rising state.
Figure 13B:
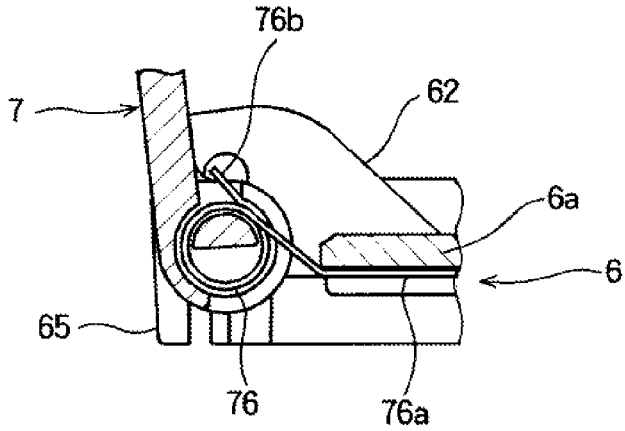

FIGS. 13(*a*) and 13(*b*) are schematic sectional views showing the medium mounting device 6 of the multifunction product 1 according to the first embodiment of the present invention. More specifically, FIG. 13(*a*) is a schematic sectional view showing the medium mounting device 6 when the stopper portion 7 is in the rising state, and FIG. 13(*b*) is a schematic sectional view showing the torsion spring 76 of the medium mounting device 6 when the stopper portion 7 in the rising state.

As shown in FIG. 12(*a*), when the stopper portion 7 in the stored state, the first abutting surface 74*a* of the protruding portion 74 abuts against the wall surface portion 65 of the medium mounting portion 6*a*. Further, as shown in FIG. 12(*b*), when the stopper portion 7 in the stored state, the second arm portion 76*b* of the torsion spring 76 urges the stopper portion 7 in the direction that the stopper portion 7 is stored in the first recessed portion 63.

In the embodiment, when the stopper portion 7 in the stored state (refer to FIGS. 12(*a*) and 12(*b*)) is switched to the rising state (refer to FIGS. 13(*a*) and 13(*b*)), the stopper portion 7 in the stored state is rotated in the direction D2 to become the rising state (refer to FIGS. 13(*a*) and 13(*b*)). When the stopper portion 7 is switched to the rising state, as shown in FIG. 13(*a*), the second abutting surface 74*b* of the protruding portion 74 abuts against the wall surface portion 65 of the medium mounting portion 6*a*. Further, as shown in FIG. 13(*b*), the second arm portion 76*b* of the torsion spring 76 urges the stopper portion 7 in the direction D1.

In the embodiment, when the stopper portion 7 in the rising state, the torsion spring 76 urges the stopper portion 7 in the direction D1 with an urging force smaller than a lower limit of the urging force sufficiently large so that the protruding portion 74 is capable of elastically deforming (bending) the wall surface portion 65 in the direction D3, and the stopper portion 7 is switched from the rising state (refer to FIGS. 13(*a*) and 13(*b*)) to the stored state (refer to FIGS. 12(*a*) and 12(*b*)). In other words, only with the urging force of the torsion spring 76 in the direction D1, the stopper portion 7 is not switched from the rising state (refer to FIGS. 13(*a*) and 13(*b*)) to the stored state (refer to FIGS. 12(*a*) and 12(*b*)). As a result, with the urging force of the torsion spring 76 in the direction D1, the second abutting surface 74*b* of the protruding portion 74 continues to abut against the wall surface portion 65, and the stopper portion 7 is maintained in the rising state.

As explained above, the second abutting surface 74*b* of the protruding portion 74 is arranged to abut against the wall surface portion 65, so that the stopper portion 7 is not switched from the rising state (refer to FIGS. 13(*a*) and 13(*b*)) to the stored state (refer to FIGS. 12(*a*) and 12(*b*)). Accordingly, the stopper portion 7 is maintained in the rising state in the vertical posture.

Further, the torsion spring 76 urges the stopper portion 7 such that the stopper portion 7 is returned from the rising state (refer to FIGS. 13(*a*) and 13(*b*)) to the stored state (refer to FIGS. 12(*a*) and 12(*b*)). However, at this moment, the urging force is smaller than the urging force (the lower limit) and sufficiently large so that the second abutting surface 74*b* of the protruding portion 74 is capable of elastically deforming (bending) the wall surface portion 65. Accordingly, it is possible to maintain the stopper portion 7 in the rising state (refer to FIGS. 13(*a*) and 13(*b*)).

Further, the torsion spring 76 urges the stopper portion 7 in the direction D1. Accordingly, as shown in FIG. 13(*a*), when the leading edge of the document 20*a* discharged on the medium mounting portion 6*a* abuts against the stopper portion 7, the stopper portion 7 does not fall down, and the leading edge of the document 20*a* is aligned. It is noted that when the stopper portion 7 is in the rising state substantially perpendicular to the medium mounting portion 6*a*, the stopper portion 7 is capable of easily aligning the document 20*a*.

Figure 14:
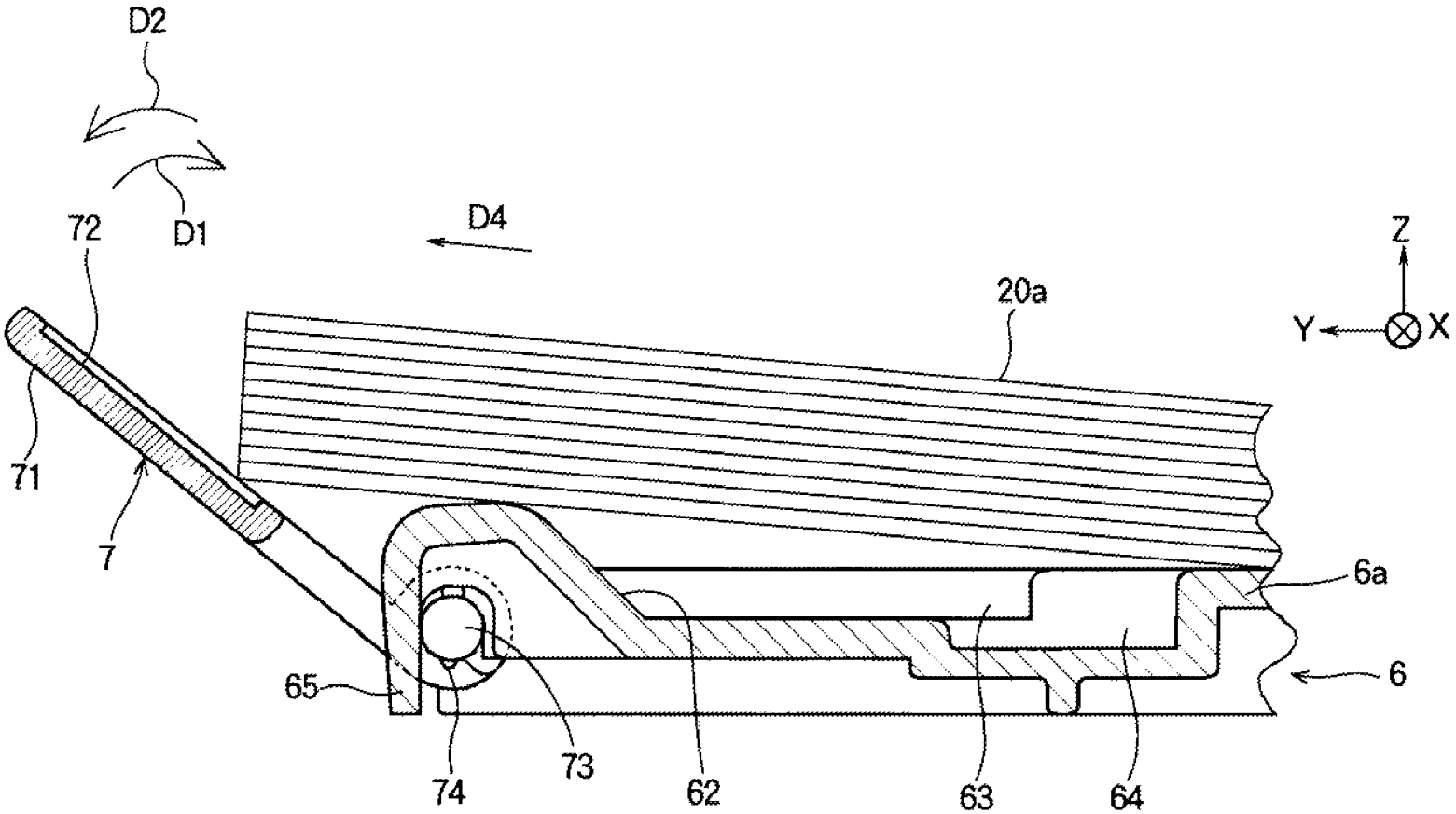
FIG. 14 is a schematic sectional view showing the medium mounting device of the multifunction product when a medium is taken out according to the first embodiment of the present invention.

FIG. 14 is a schematic sectional view showing the medium mounting device 6 of the multifunction product 1 when the medium 20*a* is taken out from the medium mounting portion 6*a* according to the first embodiment of the present invention. FIG. 14 shows the rotational movement of the stopper portion 7 from the rising state.

As shown in FIG. 14, when the medium 20*a* in the aligned state is taken out from the medium mounting portion 6*a*, the user grabs the document 20*a* from both sides of the stopper portion 7, and can pull out the document 20*a* in a direction D4. When the user pulls out the document 20*a*, as shown in FIG. 14, the pulling force of the document 20*a* exceeds the urging force of the torsion spring 76. As a result, the stopper portion 7 rotates outwardly (fall down outwardly), so that the stopper portion 7 does not block the document 20*a*.

After the document 20*a* is pulled out, the stopper portion 7 rotates back in the direction D1 with the urging force of the torsion spring 76, and the second abutting surface 74*b* of the protruding portion 74 of the stopper portion 7 returns to the position to abut against the wall surface portion 65 shown in FIG. 13(*a*). As explained above, the inclined portion 62 has an inclined surface 62*a*. Accordingly, when the document 20*a* is pulled out, the document 20*a* contacts with the backside surface 72 of the stopper portion 7 at a position away from the shaft portion 73 of the stopper portion 7. As a result, it is possible to rotate the stopper portion 7 with a relatively small pulling force.

As described above, in the medium mounting device 6, the medium reading device 2, and the MFP 1 in the first embodiment, it is configured such that the leading edge of the document 20*a* placed on the medium mounting portion 6*a* abuts against the stopper portion 7. Accordingly, it is possible to align the document 20*a* as shown FIG. 13(*a*).

Further, in the medium mounting device 6, the medium reading device 2, and the MFP 1 in the first embodiment, when the document 20*a* placed on the medium mounting portion 6*a* is taken out, as shown in FIG. 14, the document 20*a* thus pulled out rotates the stopper portion 7 outwardly. Accordingly, the stopper portion 7 does not block the document 20*a*, and it is possible to easily take out the document 20*a*.

Second Embodiment

A second embodiment of the present invention will be explained next. In the second embodiment, different from the first embodiment, a medium mounting device 206 includes a medium mounting portion 206*a*. The medium mounting portion 206*a* includes a main portion 281 and an auxiliary portion (a tray auxiliary portion 282) disposed on the main portion 281 to be slidable. Further, different from the medium mounting device 6 in the first embodiment, a stopper portion 207 is disposed on the tray auxiliary portion 282 to be rotatable.

Figure 15:
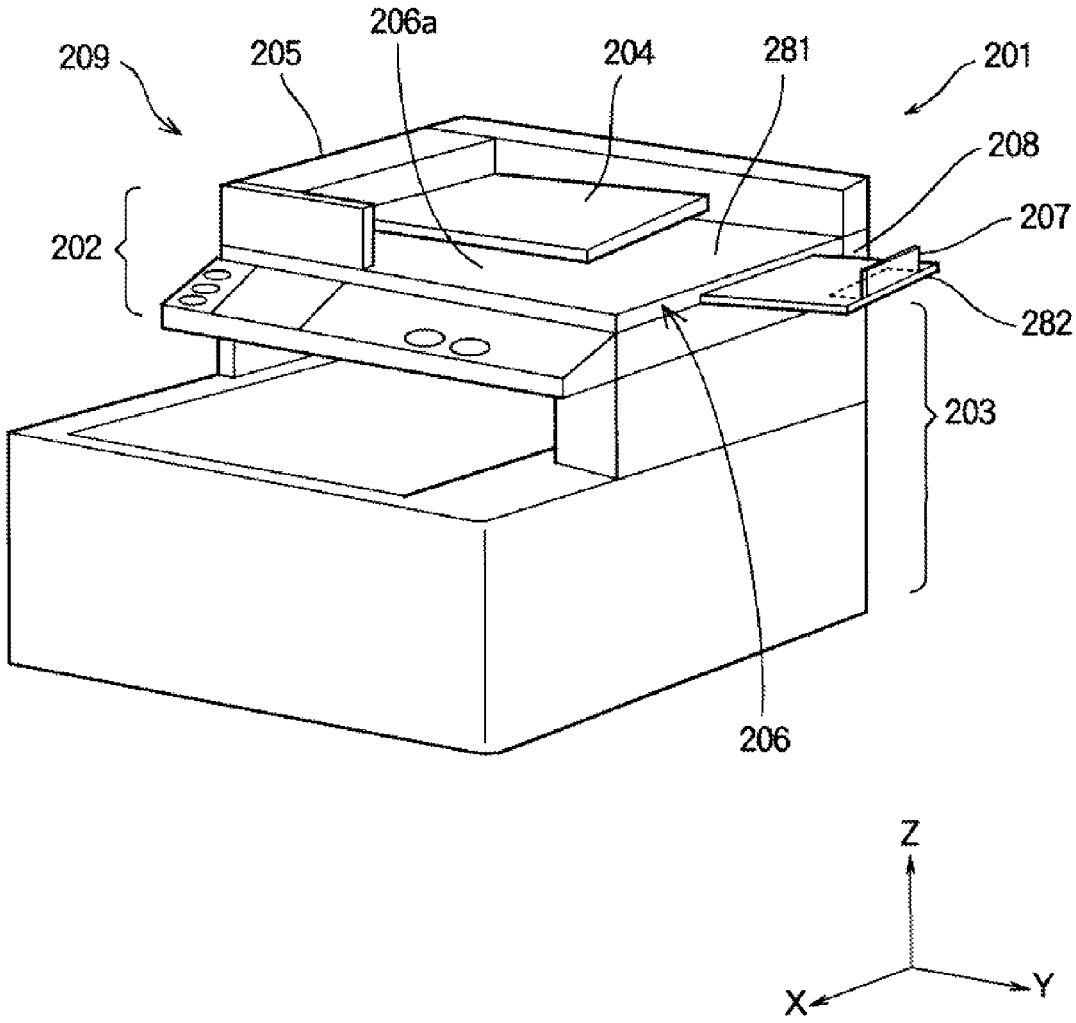
FIG. 15 is a schematic perspective view showing an outer appearance of a multifunction product according to a second embodiment of the present invention.

FIG. 15 is a schematic perspective view showing an outer appearance of a multifunction product 201 (an MFP 201) according to the second embodiment of the present invention. As shown in FIG. 15, the multifunction product 201 includes a medium reading device 202 and a printer portion 203.

In the embodiment, the medium reading device 202 is provided for optically reading an image of a document, and for transmitting image data obtained through reading to the printer portion 203. The medium reading device 202 includes a document tray 204, a transportation portion 205, the medium mounting device 206, and a flat bed 208.

In the embodiment, the medium mounting device 206 includes the medium mounting portion 206*a* for placing and mounting the medium on an upper surface thereof. The medium mounting portion 206*a* includes the main portion 281 for placing the document and the tray auxiliary portion 282 disposed on the main portion 281 to be slidable. The tray auxiliary portion 282 is pulled out according to a size of the document.

In the embodiment, the stopper portion 207 as the medium regulating portion disposed at an edge portion of the tray auxiliary portion 282 to be rotatable relative to the tray auxiliary portion 282. The document tray 204, the transportation portion 205, and the medium mounting device 206 constitute an automatic document feeder 209 (an ADF), in which the transportation portion 205 transports the document mounted on the document tray 204 to the medium mounting portion 206*a*. It is noted that the printer portion 203 has a configuration similar to that of the printer portion 3 in the first embodiment.

Figure 16:
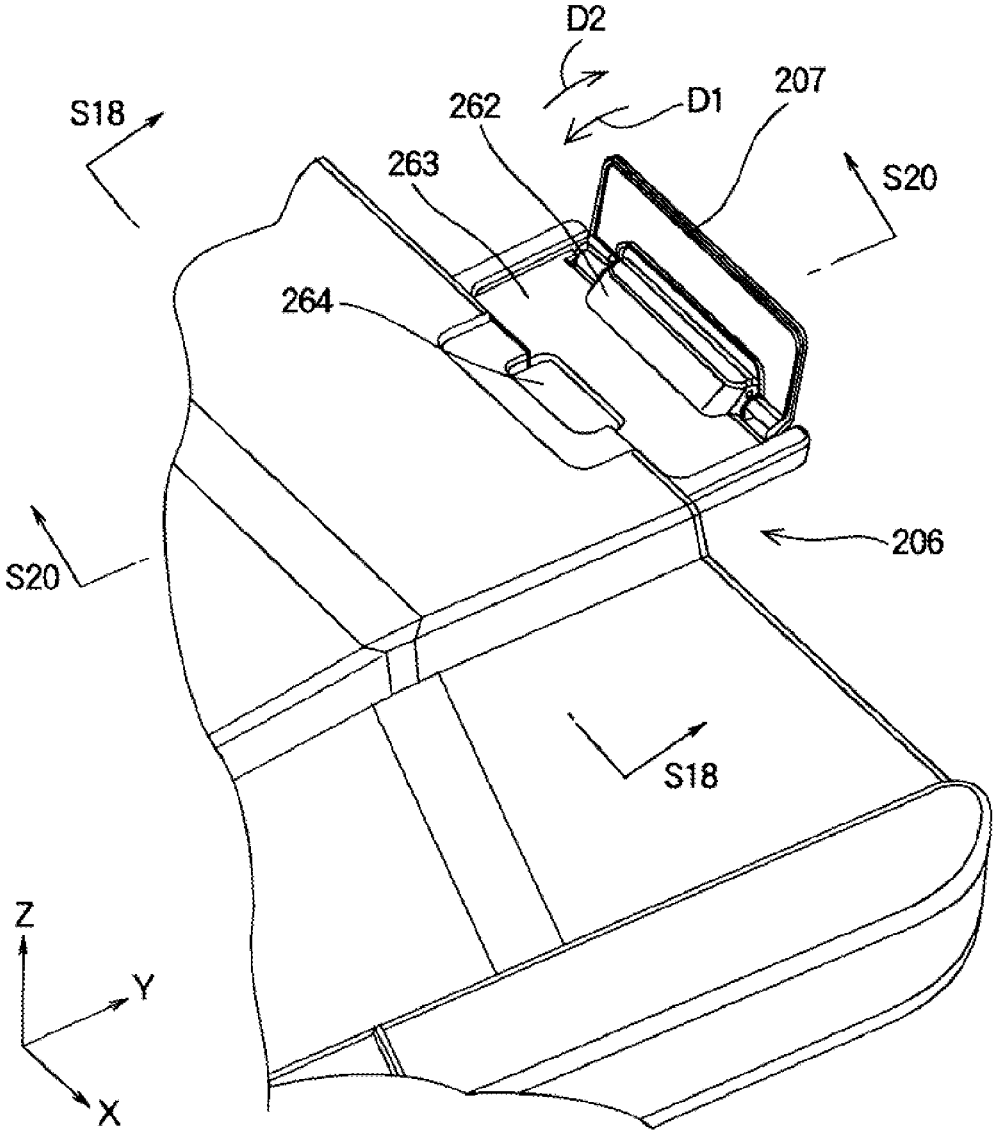
FIG. 16 is a schematic perspective view showing an outer appearance of a medium reading device of the multifunction product according to the second embodiment of the present invention.
Figure 17:
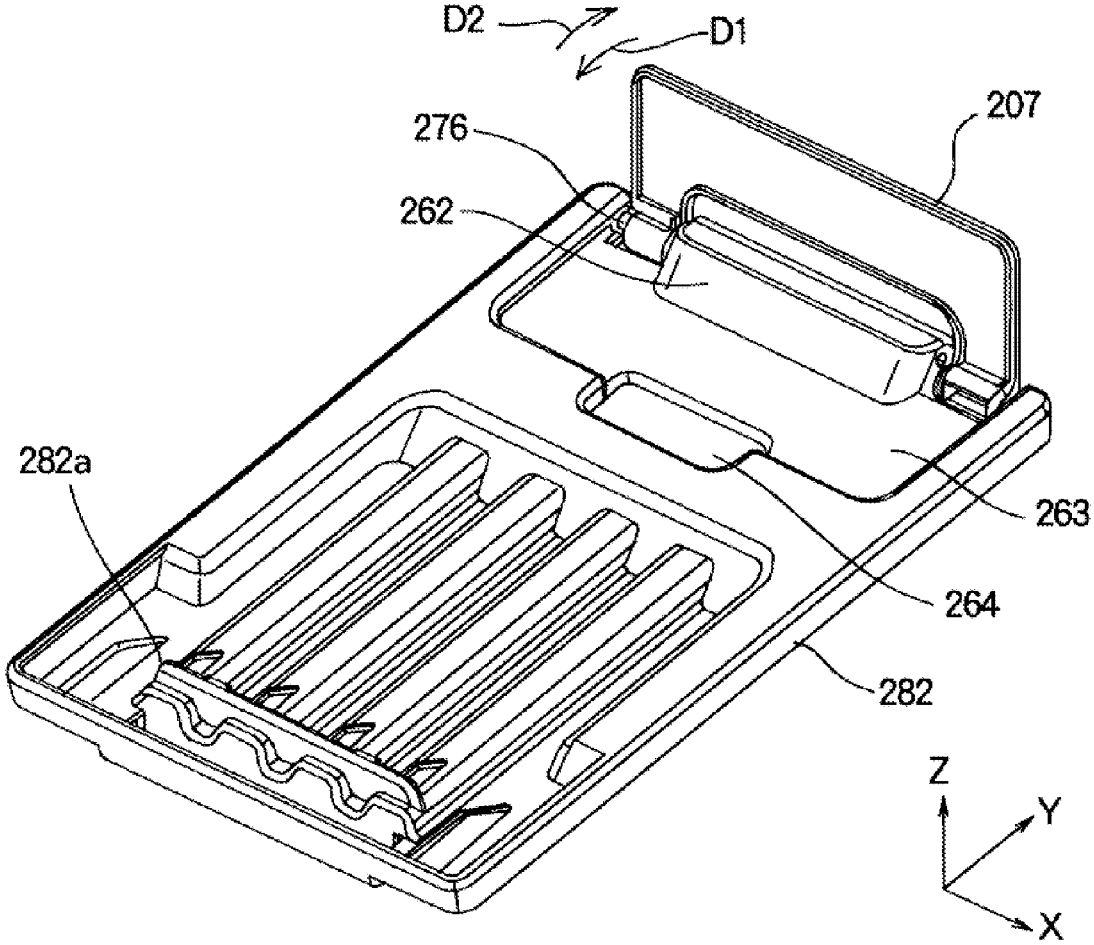
FIG. 17 is a schematic perspective view showing a tray auxiliary portion of a medium mounting device of the multifunction product according to the second embodiment of the present invention.
Figure 18:
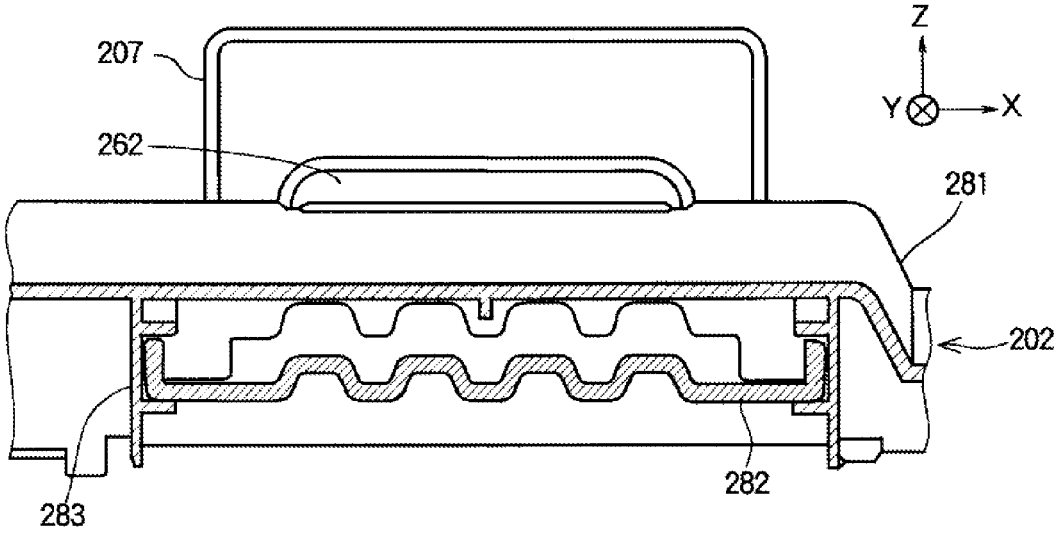
FIG. 18 is a schematic sectional view showing the medium mounting device of the multifunction product taken along a line S18-S18 in FIG. 16 according to the second embodiment of the present invention.

FIG. 16 is a schematic perspective view showing an outer appearance of the medium reading device 202 of the multifunction product 201 according to the second embodiment of the present invention. FIG. 17 is a schematic perspective view showing the tray auxiliary portion 282 of the medium mounting device 206 of the multifunction product 201 according to the second embodiment of the present invention. FIG. 18 is a schematic sectional view showing the medium mounting device 206 of the multifunction product 201 taken along a line S18-S18 in FIG. 16 according to the second embodiment of the present invention.

As shown in FIGS. 16 and 17, in the medium mounting device 206, the stopper portion 207 as the medium regulating portion is supported on the deg portion of the tray auxiliary portion 282 to be rotatable. Further, the medium mounting device 206 includes a torsion spring 276 as an urging member for urging the stopper portion 207 in a direction that the stopper portion 207 is stored in the tray auxiliary portion 282. The tray auxiliary portion 282 includes a wall surface portion 265 formed of an elastic material (refer to FIG. 19). The stopper portion 207 includes a protruding portion 274 disposed on an outer circumferential surface of a shaft portion 273 at a position facing the wall surface portion 265.

In the embodiment, the protruding portion 274 includes a first abutting surface 274*a* and a second abutting surface 274*b*. When the stopper portion 207 is stored in the tray auxiliary portion 282 in the stored state, the first abutting surface 274*a* of the protruding portion 274 abuts against the wall surface portion 265. When the stopper portion 207 is in the rising state with an urging force of the torsion spring 276, the second abutting surface 274*b* of the protruding portion 274 abuts against the wall surface portion 265. It is noted that the stopper portion 207, the shaft portion 273, the protruding portion 274, and the wall surface portion 265 have configurations similar to those of the stopper portion 7, the shaft portion 73, the protruding portion 74, and the wall surface portion 65 in the first embodiment. Further, similar to the first recessed portion 63 and the second recessed portion 64 in the first embodiment, the tray auxiliary portion 282 includes a first recessed portion 263 and a second recessed portion 264.

Figure 19:
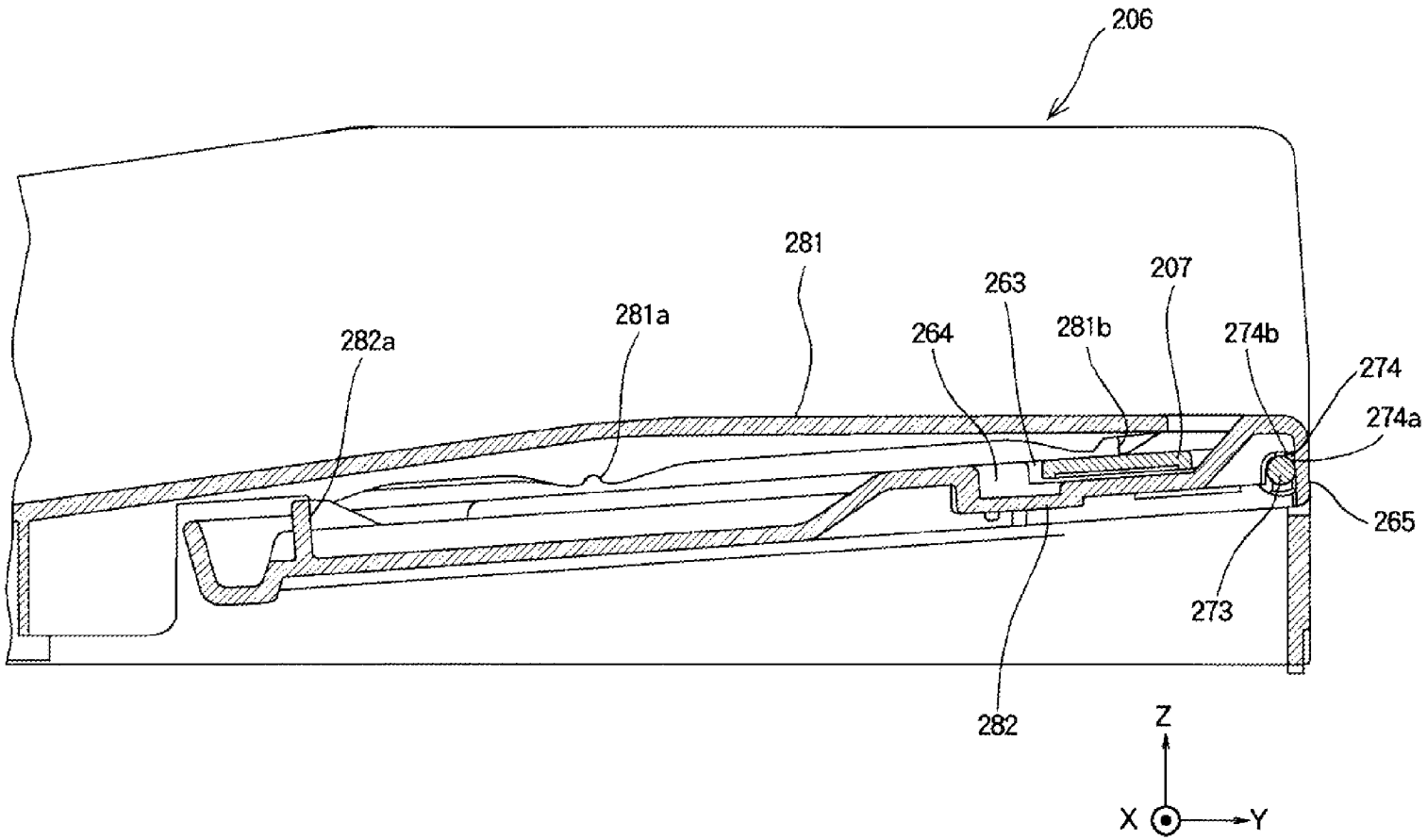
FIG. 19 is a schematic sectional view showing the medium mounting device of the multifunction product when the tray auxiliary portion is stored and a stopper portion of the medium mounting device is in a stored state according to the second embodiment of the present invention.

An operation of the medium mounting device 206 of the multifunction product 201 will be explained next. FIG. 19 is a schematic sectional view showing the medium mounting device 206 of the multifunction product 201 when the tray auxiliary portion 282 is stored and the stopper portion 207 of the medium mounting device 206 is in the stored state according to the second embodiment of the present invention.

Figure 20:
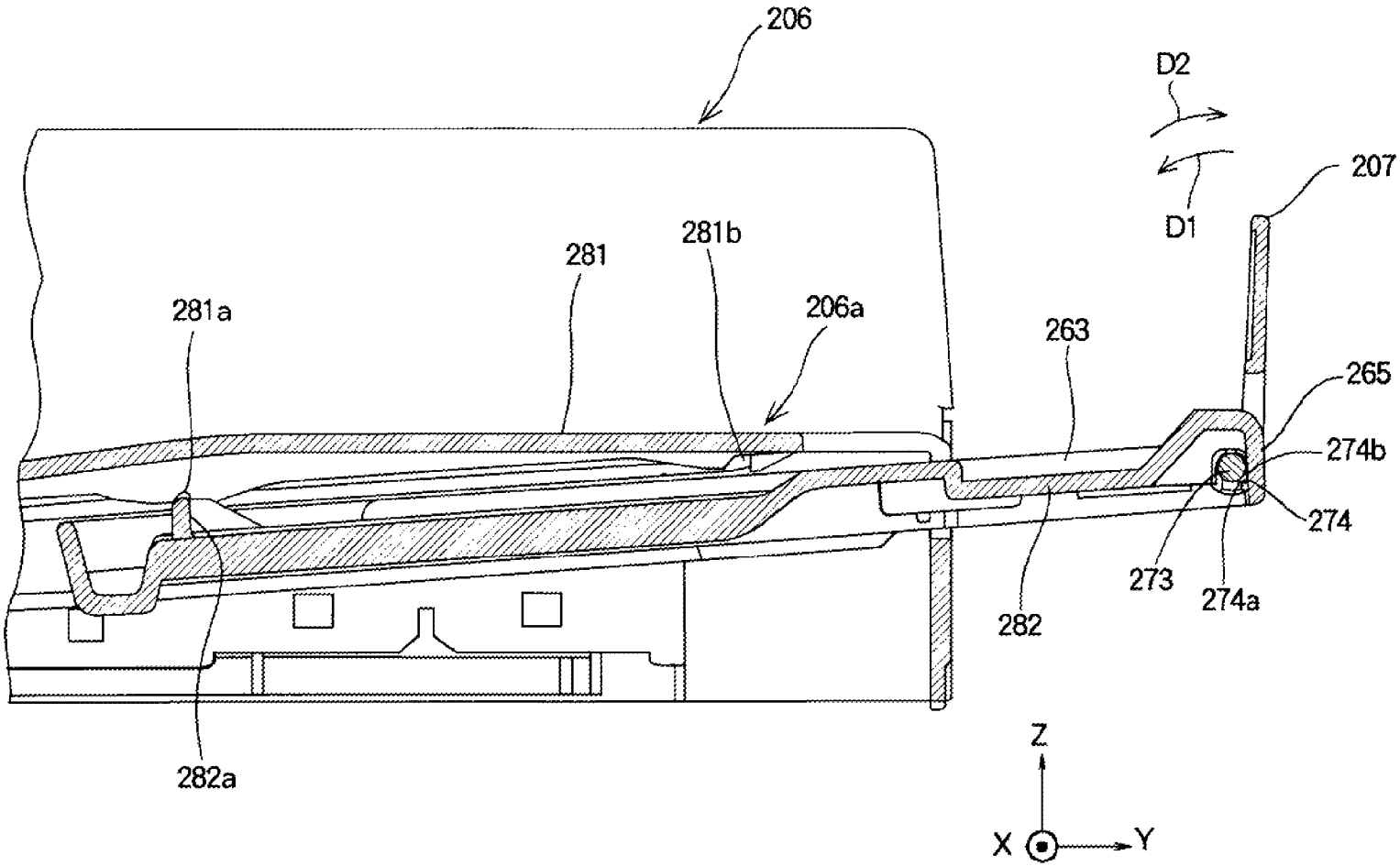
FIG. 20 is a schematic sectional view showing the medium mounting device of the multifunction product taken along a line 20-20 in FIG. 16 when the tray auxiliary portion is pulled out a little and the stopper portion is in a rising state according to the second embodiment of the present invention.
Figure 21:
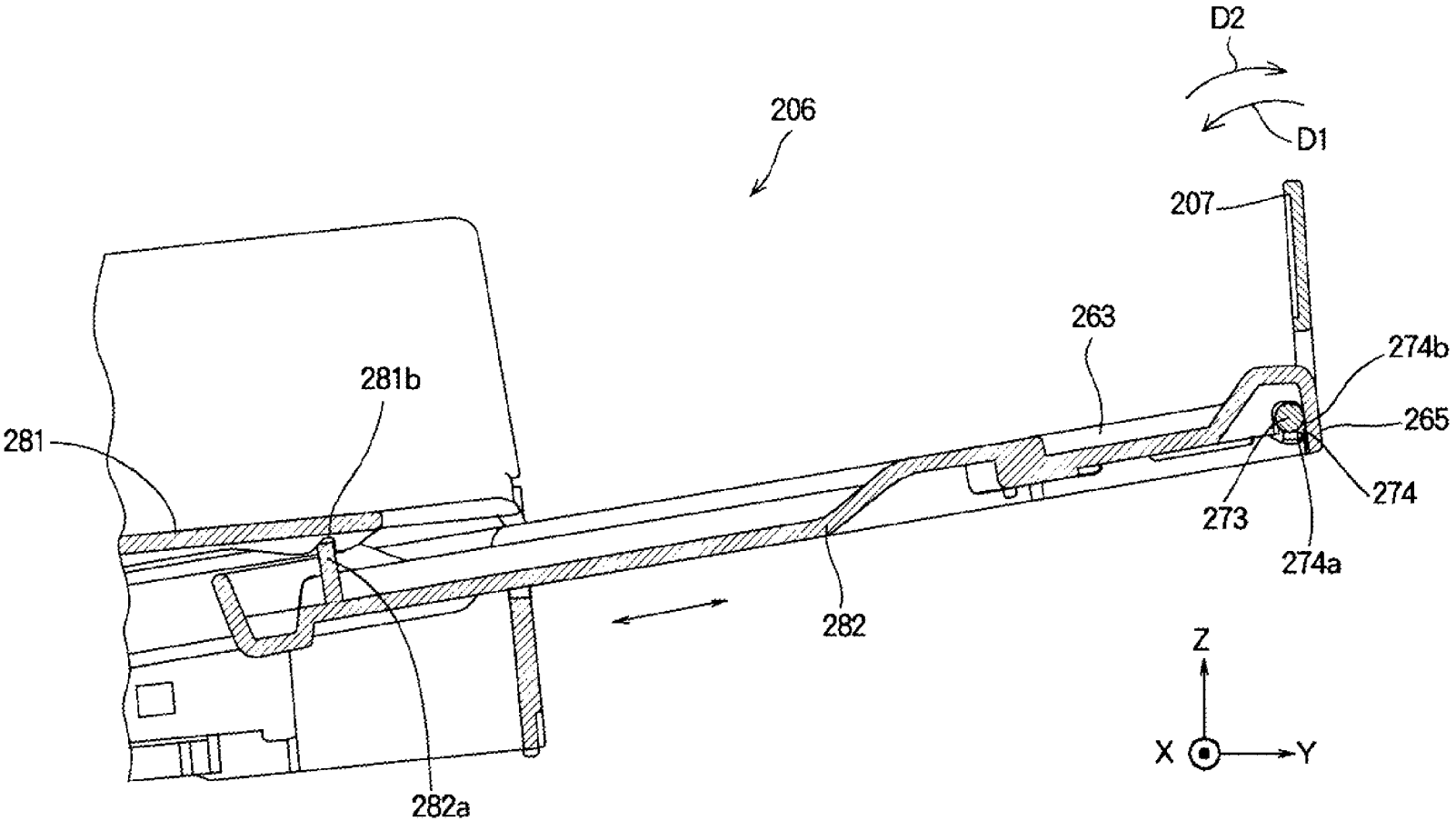
FIG. 21 is a schematic sectional view showing the medium mounting device of the multifunction product when the tray auxiliary portion is completely pulled out according to the second embodiment of the present invention.

FIG. 20 is a schematic sectional view showing the medium mounting device 206 of the multifunction product 201 taken along a line 20-20 in FIG. 16 when the tray auxiliary portion 282 is pulled out a little and the stopper portion 207 is in the rising state according to the second embodiment of the present invention. FIG. 21 is a schematic sectional view showing the medium mounting device 206 of the multifunction product 201 when the tray auxiliary portion 282 is completely pulled out according to the second embodiment of the present invention.

In the embodiment, the tray auxiliary portion 282 is accommodated in a guide portion 283 having a U-character shape section, so that the tray auxiliary portion 282 is slidable in the medium discharging direction. As shown in FIG. 16, the tray auxiliary portion 282 includes an inclined portion 262. The inclined portion 262 is provided for guiding the document toward the stopper portion 207, and also functions as a handle portion when the tray auxiliary portion 282 is slid and pulled out. When the inclined portion 262 is used as the handle portion, it is possible to easily pull out the tray auxiliary portion 282. Further, it is possible to prevent the user from grabbing the stopper portion 207, which is not suitable for using as the handle portion from the structural point of view.

As shown in FIG. 19, the tray auxiliary portion 282 includes a claw portion 282*a*, and the medium mounting portion 206*a* includes hook portions 281*a* and 281*b* for engaging with the claw portion 282*a*. With the configuration described above, it is possible to fix the tray auxiliary portion 282 at a position where the claw portion 282*a* engages with the hook portion 281*a* and a position where the claw portion 282*a* engages with the hook portion 281*b*.

An operation of the stopper portion 207 to be in the stored state and the rising state in the second embodiment is similar to that of the stopper portion 7 in the first embodiment shown in FIGS. 8, 9(*a*)-9(*b*), 10, and 11(*a*)-11(*c*). Further an operation of the stopper portion 207 to align the document in the second embodiment is similar to that of the stopper portion 7 in the first embodiment shown in FIGS. 13(*a*)-13(*b*). Further an operation of the stopper portion 207 to rotate when the document is taken out in the second embodiment is similar to that of the stopper portion 7 in the first embodiment shown in FIG. 14.

As described above, in the medium mounting device 206, the medium reading device 202, and the MFP 201 in the second embodiment, it is configured such that the leading edge of the document placed on the medium mounting portion 206*a* abuts against the stopper portion 207 disposed on the tray auxiliary portion 282. Accordingly, it is possible to align the document. Further, when the tray auxiliary portion 282 is slid, it is possible to align a long document on the medium mounting portion 206*a* with the stopper portion 207.

Further, in the medium mounting device 206, the medium reading device 202, and the MFP 201 in the second embodiment, when the document placed on the medium mounting portion 206*a* is taken out, the document thus pulled out rotates the stopper portion 207 outwardly. Accordingly, the stopper portion 207 does not block the document, and it is possible to easily take out the document.

The disclosure of Japanese Patent Application No. 2010-205514, filed on Sep. 14, 2010, is incorporated in the application by reference.

While the invention has been explained with reference to the specific embodiments of the invention, the explanation is illustrative and the invention is limited only by the appended claims.

What is claimed is:

1. A medium mounting device, comprising:

a medium mounting portion for placing a medium in a stacked state in a first direction;

a medium regulating portion arranged to be rotatable relative to the medium mounting portion, said medium regulating portion being arranged to regulate an edge portion of the medium when the medium regulating portion is in a rising state relative to the medium mounting portion, said medium regulating portion in the rising state being arranged to abut against the medium to rotate and retreat in a second direction different from the first direction; and an urging member for urging the medium regulating portion in a direction that the medium regulating portion is stored in the medium mounting portion, wherein said medium mounting portion includes a wall surface portion formed of an elastic material, said medium regulating portion includes a protruding portion at a position facing the wall surface portion, said protruding portion includes a first abutting surface for abutting against the wall surface portion when the medium regulating portion is in the rising state, said urging member is arranged to urge the medium regulating portion with a first urging force when the medium regulating portion is in the rising state, and said first urging force is smaller than a second urging force that is sufficiently large so that the protruding portion can elastically deform the wall surface portion to switch the medium regulating portion from the rising state to a stored state.

2. The medium mounting device according to claim 1, wherein said protruding portion further includes a second abutting surface for abutting against the wall surface portion when the medium regulating portion is stored in the medium mounting portion in a stored state.

3. The medium mounting device according to claim 1, wherein said medium regulating portion further includes a shaft portion with a circular cylindrical shape supported on the medium mounting portion to be rotatable, said protruding portion being disposed on an outer circumferential surface of the shaft portion.

4. The medium mounting device according to claim 1, wherein said medium mounting portion includes an inclined surface portion having a height increasing toward the medium regulating portion, said inclined surface portion being situated on an upstream side of the medium regulating portion in the second direction.

5. The medium mounting device according to claim 1, wherein said medium regulating portion has a width smaller than that of the medium having a minimum size in a rotational axial direction of the medium regulating portion.

6. The medium mounting device according to claim 1, wherein said medium regulating portion is arranged to retreat in the second direction.

7. A medium reading device comprising the medium mounting device according to claim 1; a medium placing portion disposed in a direction different from the second direction of the medium mounting portion of the medium mounting device; a reading portion for optically reading an image at a reading position; and a transportation portion for transporting the medium placed on the medium placing portion to the medium mounting portion of the medium mounting device through the reading position of the reading portion.

8. The medium reading device according to claim 7, wherein said medium placing portion is disposed in the direction perpendicular to the second direction.

9. The medium reading device according to claim 7, wherein said medium regulating portion is arranged to abut against the medium to rotate and retreat when the medium is taken out in the second direction along a medium placing surface of the medium placing portion, said medium placing surface being situated above the medium mounting portion.

10. A multifunction device comprising the medium reading device according to claim 7.

11. A multifunction device comprising the medium mounting device according to claim 1.

12. A medium mounting device, comprising:

a medium mounting portion for placing a medium in a stacked state in a first direction;

a medium regulating portion arranged to be rotatable relative to the medium mounting portion, said medium regulating portion being arranged to regulate an edge portion of the medium when the medium regulating portion is in a rising state relative to the medium mounting portion, said medium regulating portion in the rising state being arranged to abut against the medium to rotate and retreat in a second direction different from the first direction; and an urging member for urging the medium regulating portion in a direction that the medium regulating portion is stored in the medium mounting portion, wherein said medium mounting portion includes a main portion and an auxiliary portion disposed on the main portion to be slidable, said medium mounting portion includes a wall surface portion formed of an elastic material, said medium regulating portion includes a protruding portion at a position facing the wall surface portion, said protruding portion includes a first abutting surface for abutting against the wall surface portion when the medium regulating portion is in the rising state, said urging member is arranged to urge the medium regulating portion with a first urging force when the medium regulating portion is in the rising state, and said first urging force is smaller than a second urging force that is sufficiently large so that the protruding portion can elastically deform the wall surface portion to switch the medium regulating portion from the rising state to a stored state.

13. The medium mounting device according to claim 12, wherein said protruding portion further includes a second abutting surface for abutting against the wall surface portion when the medium regulating portion is stored in the auxiliary portion in a stored state.

14. The medium mounting device according to claim 12, wherein said medium regulating portion further includes a shaft portion with a circular cylindrical shape supported on the medium mounting portion to be rotatable, said protruding portion being, disposed on an outer circumferential surface of the shaft portion.

15. The medium mounting device according to claim 12, wherein said auxiliary portion includes an inclined surface portion having a height increasing toward the medium regulating portion, said inclined surface portion being situated on an upstream side of the medium regulating portion in the second direction.

* * * * *